United States Patent [19]

Elfgren et al.

[11] 3,936,784

[45] Feb. 3, 1976

[54] OIL-FILLED APPARATUS WITH MEANS FOR ACHIEVING PRESSURE BETWEEN PARTS THEREOF

[75] Inventors: Carl Elfgren; Erich Spicar, both of Ludvika, Sweden

[73] Assignee: Allmanna Svenska Elektriska Aktiebolaget, Vasteras, Sweden

[22] Filed: May 23, 1974

[21] Appl. No.: 472,906

[30] Foreign Application Priority Data

June 20, 1973 Sweden ..... 7308657

[52] U.S. Cl. ..... 336/94; 336/60; 336/197; 336/206

[51] Int. Cl.[2] ..... H01F 27/30

[58] Field of Search ..... 336/92, 94, 206, 207, 70, 336/60, 185, 197; 174/110 F; 317/256, 258, 259

[56] References Cited

UNITED STATES PATENTS

| | | | |
|---|---|---|---|
| 3,193,426 | 7/1965 | Schafer | 174/110 F |
| 3,210,648 | 10/1965 | Lockie | 336/70 X |
| 3,389,311 | 6/1968 | Royno | 317/256 |
| 3,634,798 | 1/1972 | Astleford, Jr. et al. | 336/92 |
| 3,644,858 | 2/1972 | Galloway | 336/92 |
| R27,823 | 11/1973 | Cox | 317/259 X |

FOREIGN PATENTS OR APPLICATIONS

| | | | |
|---|---|---|---|
| 1,564,792 | 4/1975 | Germany | 317/258 |

*Primary Examiner*—Thomas J. Kozma

[57] ABSTRACT

In an oil-filled apparatus, such as a transformer, having parts between which pressure is to be applied, such pressure is produced by providing between the parts bodies of an elastomer which absorbs the oil and expands as a result of such absorption. Such bodies may be used between windings and cores or as a seal between a transformer lid and a flange.

4 Claims, 7 Drawing Figures

OIL-FILLED APPARATUS WITH MEANS FOR ACHIEVING PRESSURE BETWEEN PARTS THEREOF

BACKGROUND OF THE INVENTION

1. Field of the Invention

The invention relates to oil-filled apparatus, such as transformers and to means to exerting pressures therein.

2. The Prior Art

To avoid deformation of the windings in power transformers as a consequence of the mechanical stresses during short-circuits, the windings are clamped axially against the core yoke. This is accomplished by building a permanent self-stress into the winding-core system or by means of mechanical elements which may be adjusted afterwards.

A radial de-stressing of the inner winding against the core would be the best protection against deformation of the winding during short-circuit periods, but unfortunately it is very difficult to achieve this.

Resilient elements in the axial or radial power flux would maintain part of the self-stresses. Metallic elements are cumbersome from the structural point of view and are often impossible to use for technical reasons having to do with the insulation. Elements which are based on elastic deformation of, for example, glass-fibre-reinforced plastics become yielding at high temperature. Furthermore, metallic as well as glass-fibre-reinforced elements must necessarily have a certain overall height, which makes it difficult to find a place for them. Also deformed rubber is out of the question, since even the best qualities undergo deformation and de-stressing at high temperature.

However, rubber and similar materials can be used in other ways than through deformation in order to obtain elastic elements without plastic destressing. Certain qualities of rubber are known to absorb transformer oil in their joints, thus causing it to swell. The swelling is dependent on the temperature so that it increases at increasing temperatures, but it is also reversible, which means that if the temperature decreases part of the absorbed oil drains off. Hot-vulcanized silicone rubber undergoes a pronounced swelling in transformer oil. The type of rubber and the number of cross-links per rubber molecule determine the swelling. If the correct material is used, the swelling is not destructive to the rubber.

If a swelling body is enclosed in a limited space and allowed to swell, it builds up a self-stress until equilibrium has been attained. This is characterised by the fact that the chemical potential of the oil in the rubber is the same as the chemical potential of the oil in the free liquid.

SUMMARY OF THE INVENTION

The present invention relates to applications of such properties in certain elastomers in combination with transformer oil for achieving mechanical forces for clamping windings, for sealing purposes and the like in oil-filled apparatus such as transformers, reactors and the like. According to the invention, swelling bodies of oil-absorbing and thus swelling elastomers are arranged as support bodies for windings or as sealing materials in joints in the tanks in which the apparatus are enclosed.

BRIEF DESCRIPTION OF THE DRAWINGS

The accompanying drawings show a few examples of how the invention can be applied for clamping transformer windings.

DESCRIPTION OF THE PREFERRED EMBODIMENTS

Figure 1:
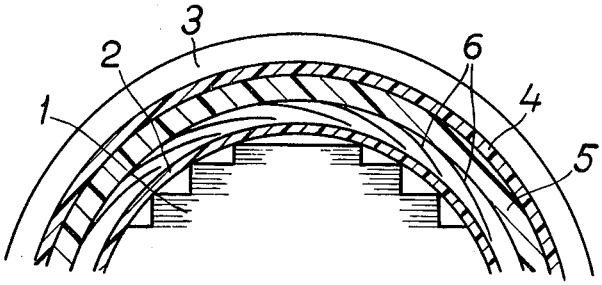
FIGS. 1 and 2 show two somewhat different arrangements for radial clamping of a winding.

FIG. 1 shows a horizontal section through a core leg 1. A pressboard cylinder 2 acts as insulation around the core leg. Inside the innermost winding 3 lies another pressboard cylinder 4. The inside of the cylinder supports a layer 5 of a type of rubber which is capable of absorbing transformer oil and thereby swelling and thus constitutes a cylindrical swelling body. During the assembly the space between the rubber bearing 5 and the inner pressboard cylinder 2 is filled with slightly bent vertical discs 6 of pressboard which, before the rubber layer has swelled, keep it clamped between the cylinders 2 and 4. When the transformer is filled with oil and the rubber layer swells, the pressboard discs are compressed in the reduced space between the rubber layer and the cylinder 2.

Figure 2:
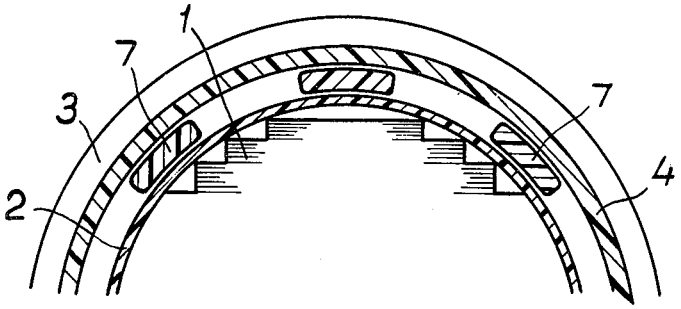

FIG. 2 shows a variant of the clamping arrangement according to FIG. 1. The cylindrical swelling body 5 shown in FIG. 1 is replaced in FIG. 2 by a number of vertically swelling bodies 7 in the form of strips which are applied between the two pressboard cylinders 2 and 4. The thickness of the rod-shaped swelling bodies is preferably chosen so that, in non-swelled condition, they are somewhat compressed and are thus kept in position between the cylinders 2 and 4. The bodies are encapsulated in, for example, a glass-fibre stocking or built up or rubber laminated with fabric. When the swelling bodies are brought into contact with the oil when it is filled into the transformer, the bodies 7 start swelling and expanding preferably in the radial direction in the space between the cylinders, so that the winding is affected by a radially outwardly acting pressure, by which means the windings are perfectly supported.

Figure 3:
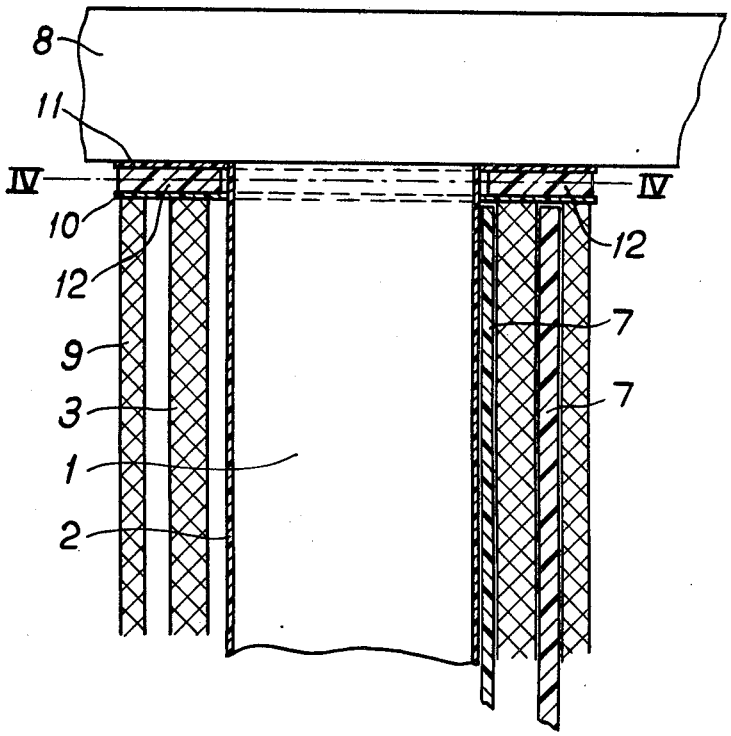
FIG. 3 is a vertical section through the upper portion of a winding and a core leg to show an axially clamped winding.
Figure 4:
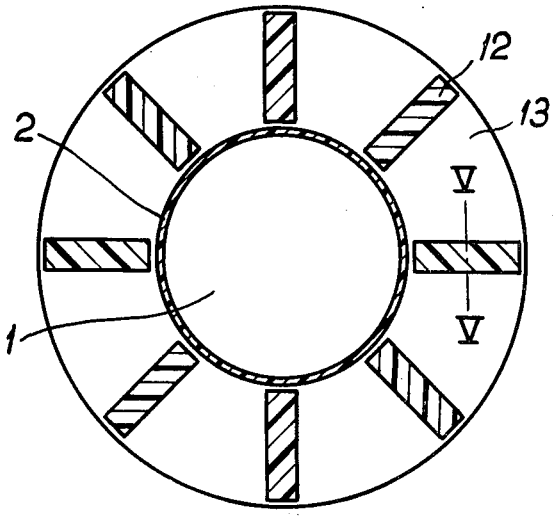
FIG. 4 is a horizontal section along the line Iv –IV in FIG. 3.

FIG. 3 shows a vertical section through the upper end of a transformer core leg 1, a part of the upper yoke 8 and two windings 3 and 9 arranged around the core leg. A pressboard cylinder 2 surrounds the core leg. A boss ring structure is applied between the upper end surface of the windings and the lower side of the yoke, said ring structure consisting of a lower ring 10 and an upper ring 11 of pressboard and a number of radially arranged bosses 12 between the two rings. FIG. 4 is a horizontal section through a boss ring and from FIG. 4 it is clear that broad, radial channels 13 for the oil are formed between the bosses.

Figure 5:
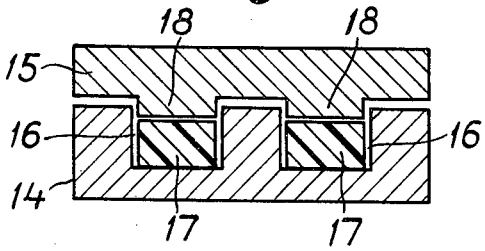
FIG. 5 is a cross-section along the line V–V.
Figure 6:
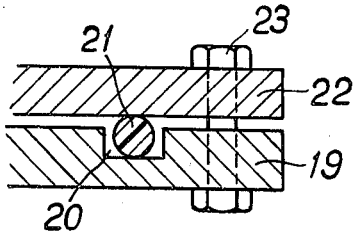
FIGS. 6 and 7 show the invention applied to a sealing joint.
Figure 7:
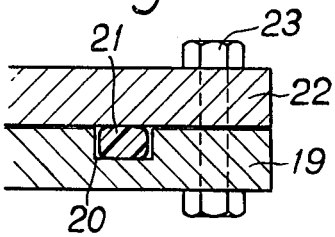

To achieve axial clamping of the windings the invention is applied, for example, in such a way that the bosses 12 contain swelling bodies and FIG. 5, being a cross-section through a boss along the line V–V in FIG. 4, shows that the boss is divided and consists of a lower part 14 and an upper part 15. The lower part is provided with a number of notches 16 in which blocks 17 of rubber are placed. The upper part is suitably provided with downwardly directed projections 18 which project into the notches and make contact with the blocks. When the rubber blocks begin to swell under the action of the oil, the lower and upper parts are pressed apart and an axially directed pressure force from the yoke towards the end surface of the winding is obtained.

Swelling bodies can be applied not only between the core leg and the inner winding, as shown in FIGS. 1 and 2, but also between two windings. Thus, the right-hand part of FIG. 3 shows that strips 7 of expansible rubber are arranged, on the one hand, between the core leg 1 and winding 3 and, on the other hand, between the two windings 3 and 9. If it is desired that a swelling body should swell only in one direction, it is provided with a wrapping or is enclosed in some other way so that the rubber is prevented from swelling except in the desired direction. In this way the swelling effect can be strengthened in a certain desired direction. As an example of this may be mentioned swelling bodies built up and vulcanized together from alternate layers of a suitable rubber and inserted fibre mats.

We claim:

1. An oil-filled apparatus having an iron core part and winding parts arranged on said core part, a casing enclosing said parts, there being a space between two of said parts, and means for exerting pressure force between said core part and said winding parts, said means comprising bodies of an elastomer which absorbs oil and swells as a result of such absorption located in said space.

2. An apparatus as claimed in claim 1, in which said apparatus is a transformer and one of said winding parts is a transformer winding.

3. An apparatus as claimed in claim 2, in which the core part is a transformer core leg.

4. An apparatus as claimed in claim 2, in which the core part is a transformer yoke.

* * * * *